US005208982A

United States Patent [19]

Ferruzza, Jr.

[11] Patent Number: 5,208,982

[45] Date of Patent: May 11, 1993

[54] DEVICE TO SHAVE CONCAVE AREAS

[76] Inventor: Gerald A. Ferruzza, Jr., 1150 Cherry St., Lakeville, Mass. 02347

[21] Appl. No.: 957,622

[22] Filed: Oct. 6, 1992

Related U.S. Application Data

[63] Continuation-in-part of Ser. No. 837,752, Feb. 19, 1992, abandoned.

[51] Int. Cl.[5] ..... B26B 21/00

[52] U.S. Cl. ..... 30/49

[58] Field of Search ..... 30/32, 42, 49, 347, 30/356

[56] References Cited

U.S. PATENT DOCUMENTS

| | | | |
|---|---|---|---|
| 1,485,093 | 2/1924 | Speirs | 30/49 |
| 1,821,825 | 9/1931 | Zumwalt | 30/49 |
| 2,069,465 | 2/1937 | Wallenbeck | 30/49 |
| 2,501,987 | 3/1950 | Brown | 30/49 |
| 4,651,735 | 3/1987 | Berger | 30/49 |

FOREIGN PATENT DOCUMENTS

| | | | |
|---|---|---|---|
| 286594 | 3/1953 | Switzerland | 30/49 |
| 521580 | 5/1940 | United Kingdom | 30/49 |

*Primary Examiner*—Frank T. Yost
*Assistant Examiner*—Paul M. Heyrana, Sr.

[57] ABSTRACT

This invention provides a device to shave concave areas utilizing a blade bent into an arc where the blade sharpened edge is mounted on a cylindrical or conical surface in a convex shape. In one embodiment the lead in surface is a spherical segment with grooves to guide hairs and the blade edge is mounted projecting slightly over a slot located at the intersection between the cylindrical and the spherical surfaces. This method allows nick free shaving of concavities.

3 Claims, 4 Drawing Sheets

DEVICE TO SHAVE CONCAVE AREAS

This is a continuation-in-part of co-pending application Ser. No. 07/837,752 filed on Feb. 19, 1992 abandoned Oct. 6, 1992.

BACKGROUND OF THE INVENTION

1. Field of the Invention

This invention relates to shaving devices and more specifically to an arced head.

SUMMARY OF THE INVENTION

The invention disclosed herein is directed at a combination of arced head and razor which removes hair from concave and hard to reach areas of the human body and which reduces the possibility of cuts while using the shaving device.

BRIEF DESCRIPTION OF THE DRAWINGS

Further details are explained below with the help of the example(s) illustrated in the attached drawings in which.

DESCRIPTION OF THE PREFERRED EMBODIMENT(S)

Figure 1:
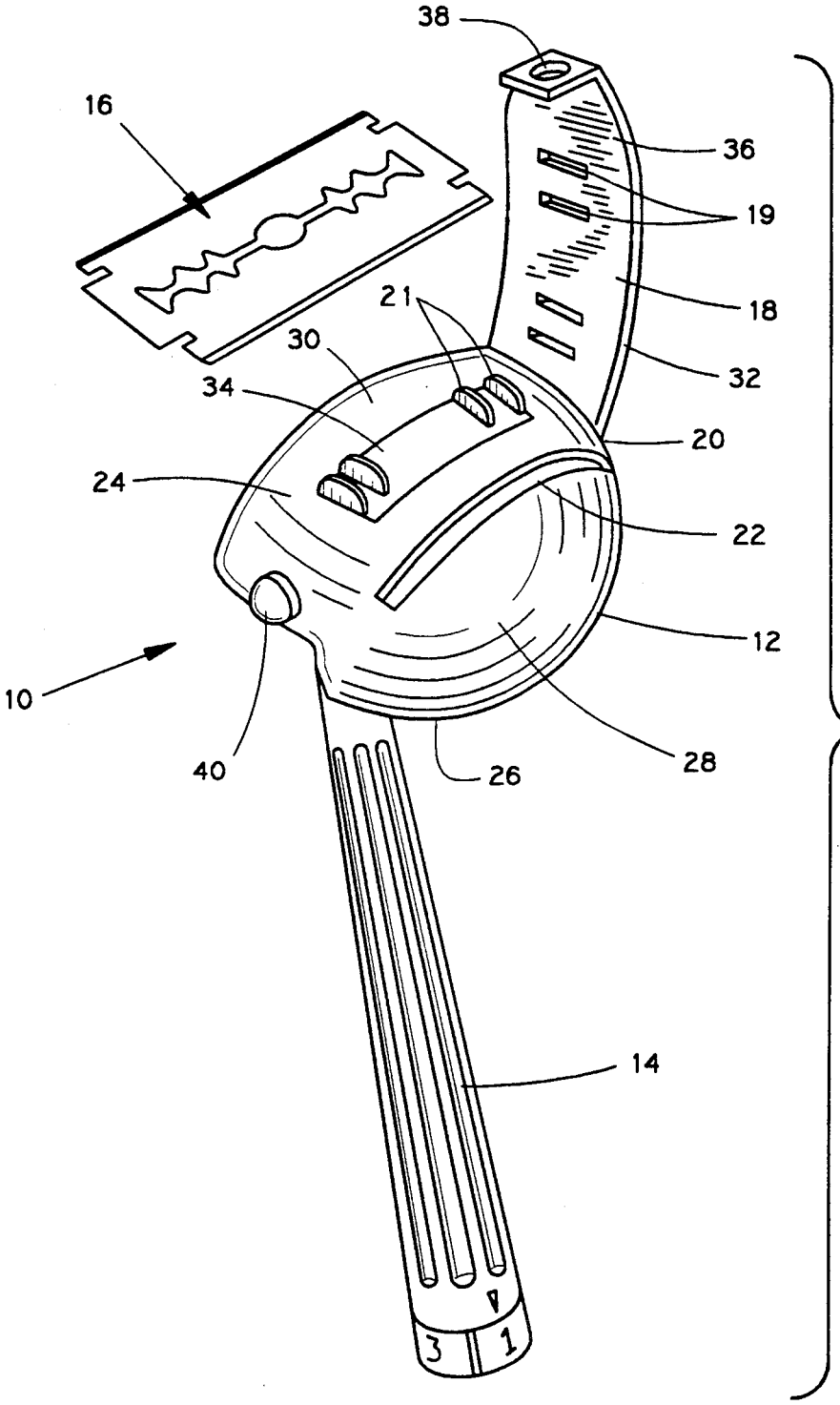
FIG. 1. is a perspective view partially exploded of the shaving device, according to the present invention.

There is shown in the drawings a razor 10 comprising a head 12, a handle 14 and a razor blade 16. The head 12 including a body portion 28 having an upper surface 24, a lower surface 26 and a cover 18. The upper surface 24 includes a top portion 30. The head is arcuate in configuration, has engagement means 20, a hinge for example, for movably engaging the cover 18 and a series of attachment apertures 21. The cover 18, when engaged, is positioned in superposed relation to the top portion 30 of the upper surface 24 and has a leading edge 32.

A slot 22 is formed in the upper surface 24 of the body portion 28 and spaced forwardly of the leading edge 32 of the cover 18 when it is engaged. A trough like section 34 is formed on the top portion 30 of the head 12. The section 34 has a length equal to the length of the razor blade 16. The cover 18 comprises a generally rectangular base 36 having a series of fastening members 19 and having a first end hingedly connected through the engagement means 20 to the head 12 and the other end having a first attachment means 38 extending therefrom as shown in FIG. 1. A second attachment means 40 is formed on the upper surface 24 of the head 12 aligned with the longitudinal axis of the section 34. The razor blade 16 is placed in the section 34 positioning it at the circumference of the head 12 with its horizontal plane in parallel relation therewith. The razor blade 16 is of the double edge type and one of the edges, to be used for shaving, projects slightly into the area defined by the slot 22. The cover 18 is engaged to the head 12. This engagement positions each of the fastening members 19 within its respective attachment apertures 21 with the first attachment means 38 connected to the second attachment means 40. The razor 10 may now be used for shaving.

Figure 2:
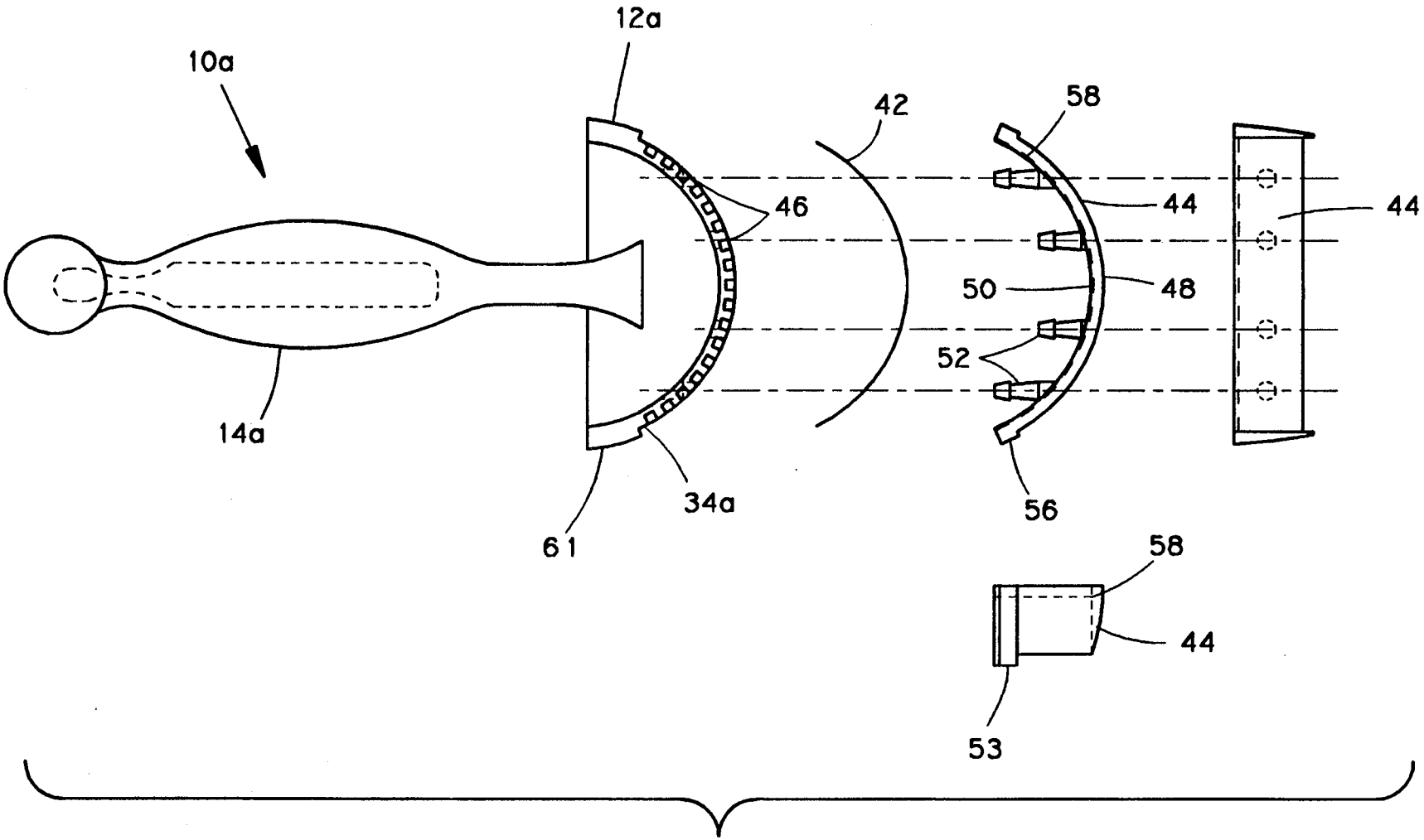
FIG. 2. is an exploded side elevational view of a variation of the shaving device, shown in FIG. 1 according to the present invention.
Figure 3:
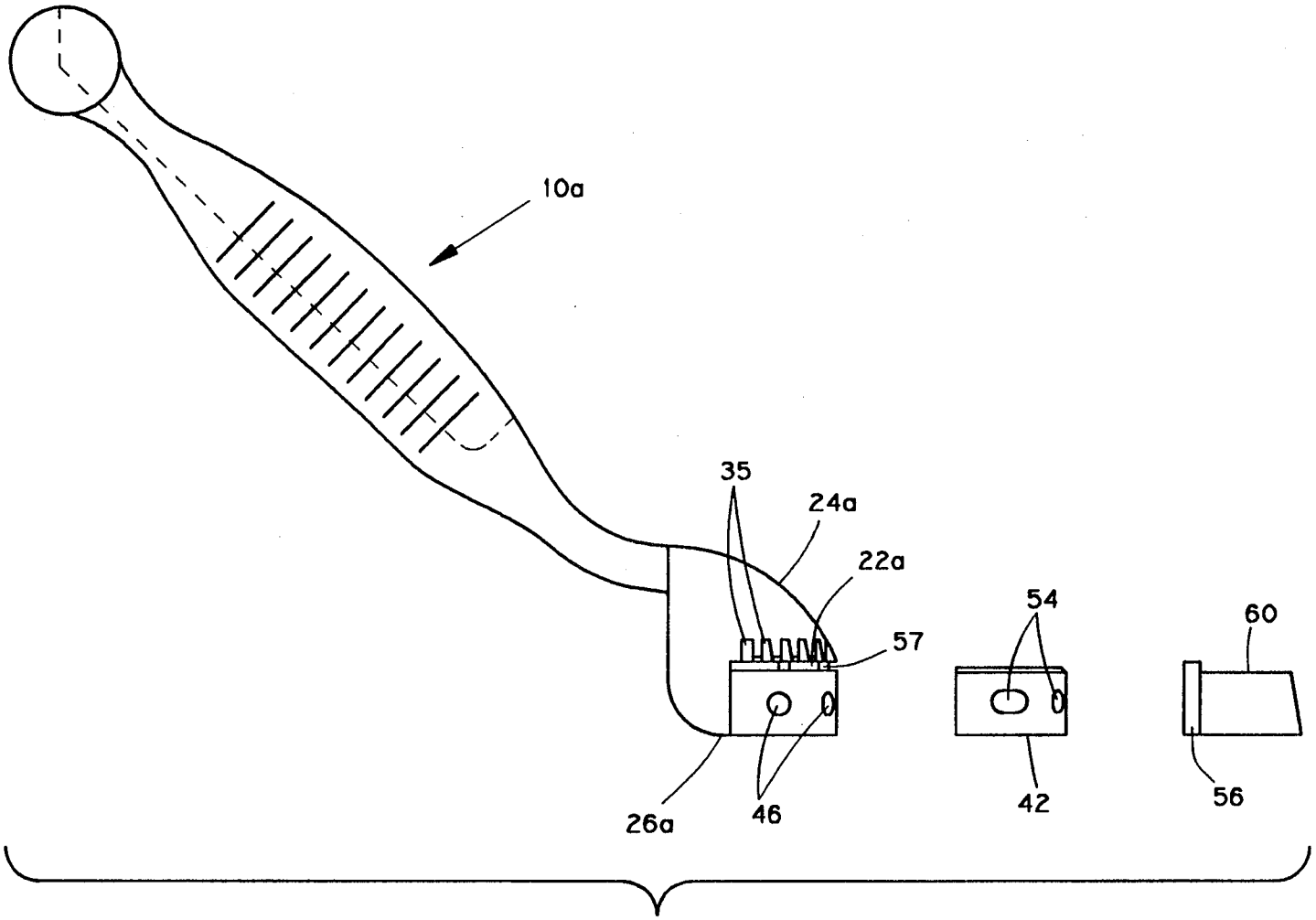
FIG. 3 is a side elevational view of the shaving device, shown in FIG. 2l.
Figure 5:
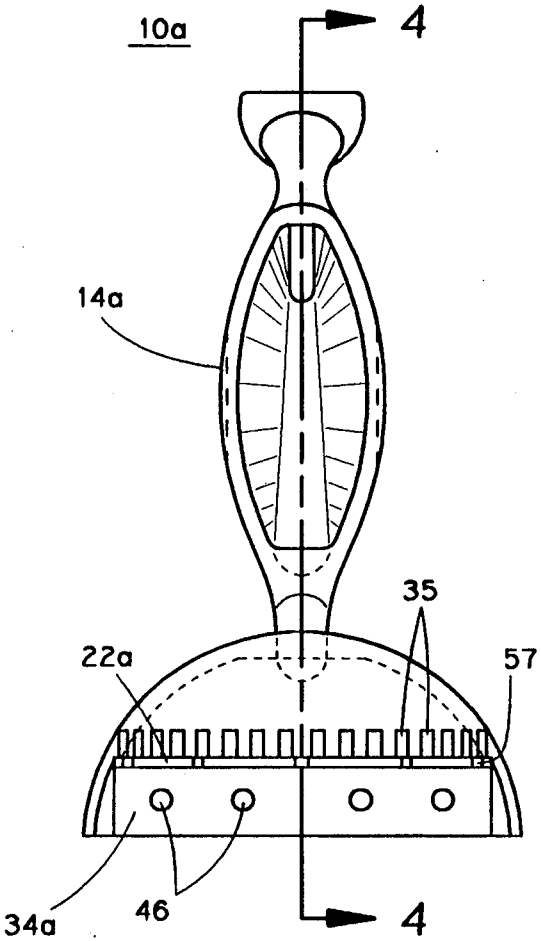
FIG. 5 is a bottom plan view of the shaving device, shown in FIG. 2.
Figure 4:
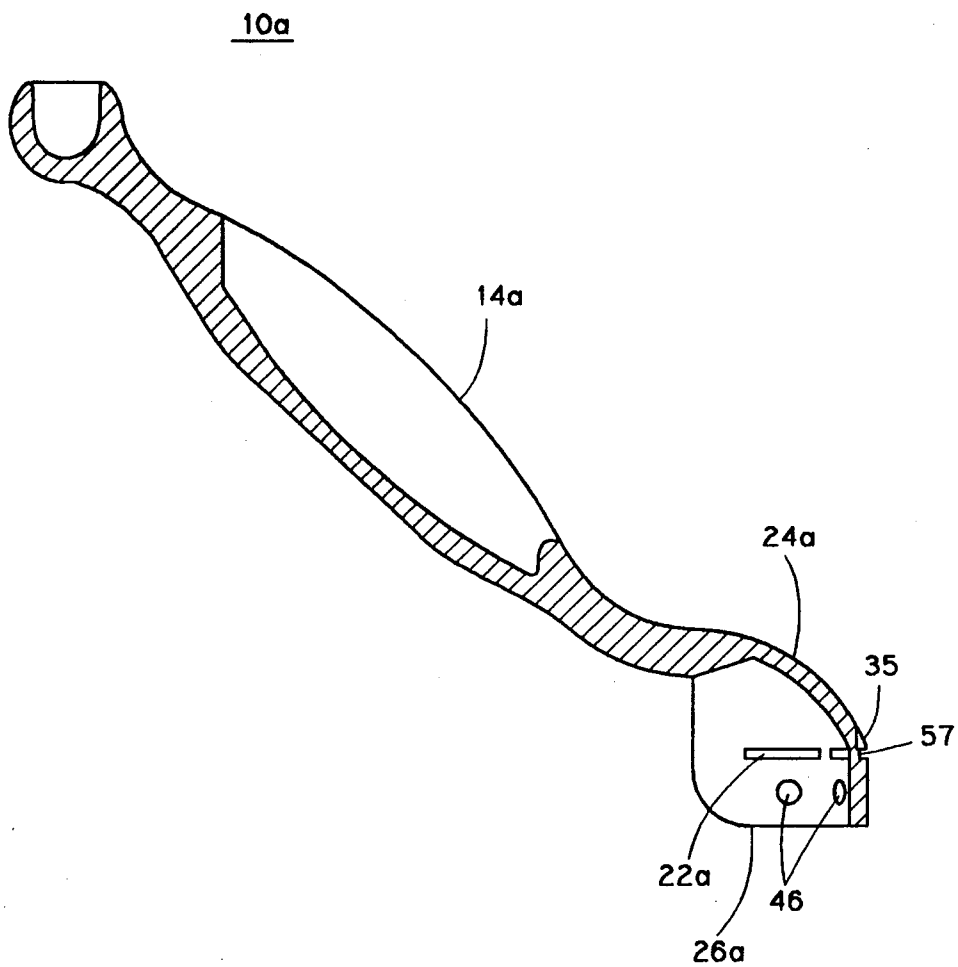
FIG. 4 is a sectional side elevational view of the shaving device, shown in FIG. 2.

A variation 10*a* of the razor 10 is shown in FIGS. 2–4. The variation razor 10*a* comprising a head 12*a*, a handle 14*a*, sheath 44 and a strip blade 42. The head 12*a* may be formed of plastic material and the handle 14*a* may be formed integral with and extend from it. The configuration of the head 12*a* is similar to a section of a sphere and includes an upper surface 24*a* and a lower surface 26*a*. A trough like section 34*a* is formed on the upper surface 24*a* of the head 12*a*. The section 34*a* has a length equal to the length of the strip blade 42, includes a series of spaced through apertures 46 and accords with the configuration of the head 12*a*. A slot 22*a* is formed in the upper surface 24*a* of the head 12*a* spaced forwardly of the leading edge of the section 34*a* and a series of grooves 35 are formed in the head 12*a* extending from the forward edge of the slot 22*a*. The grooves 35 are in spaced parallel relation to each other. The sheath 44 comprises a generally rectangular arced base portion 48 having an under surface 50 from which a series of spaced engagement studs 52 extend. The strip blade 42 includes a series of through holes 54. The strip blade 42 is placed in the section 34*a* aligning the holes 54 with the apertures 46. The razor edge of the strip blade 42 projects slightly into the area defined by the slot 22*a*. The sheath 44 is engaged to the head 12*a* and the strip blade 42 by inserting each of the engagement studs 52 through a hole 54 and into engagement with its respective the aperture 46. A boss 56 is formed on the top surface at each terminal end of the sheath 44. The boss 56 extends beyond the leading edge of the sheath 44 and has an upper surface positioned slightly above the upper surface 24*a* when it is engaged to the head 12*a*. The razor 10*a* may now be used for shaving.

I claim:

1. A razor comprising a head, a handle and a razor blade, the head including a body portion having an upper surface and a lower surface and a cover, the upper surface including a top portion and slot, the head being arcuate in configuration and having hinged means of movably engaging the cover, the cover positioned on the top portion of the upper surface and having a leading edge, a slot formed in the upper surface of the body portion and spaced from the leading edge of the cover, the razor blade positioned on the top portion.

2. A razor comprising a head, a handle, a sheath and a strip blade, the head including a body portion having an upper surface and a lower surface, the upper surface having a trough like section formed therein, the trough like section including a series of spaced through apertures and having a leading edge, a slot being formed in the upper surface of the body portion, spaced from the leading edge of the trough like section and having a front edge, the sheath comprises a generally rectangular arced base portion having an under surface from which a series of spaced engagement studs extend, the strip blade includes a series of through holes and a cutting edge, the strip blade positioned in the section aligning the holes with the apertures and with the cutting edge projecting into the area defined by the slot, the sheath engaged to the head and the strip blade by inserting each of the engagement studs through a hole into engagement with its respective aperture thereby fixing the strip blade in relation to the head.

3. A razor as set forth in claim 2 wherein the head having a series of grooves formed therein extending from the front edge of the slot, the grooves in spaced parallel relation to each other.

* * * * *

UNITED STATES PATENT AND TRADEMARK OFFICE

CERTIFICATE OF CORRECTION

PATENT NO. : 5,208,982
DATED : May 11, 1993
INVENTOR(S) : Gerald A. Sferruzza, Jr.

It is certified that error appears in the above-indentified patent and that said Letters Patent is hereby corrected as shown below:

On the title page, items [19] and [75] the inventor's last name is misspelled it should read --Sferruzza--.

Signed and Sealed this

Twenty-sixth Day of April, 1994

*Attest:*

*Attesting Officer*

BRUCE LEHMAN

*Commissioner of Patents and Trademarks*